United States Patent [19]

Ebihara

[11] Patent Number: 4,706,866

[45] Date of Patent: Nov. 17, 1987

[54] STAPLER

[75] Inventor: Yoshiyuki Ebihara, Tokyo, Japan

[73] Assignee: Etona Company, Limited, Japan

[21] Appl. No.: 896,189

[22] Filed: Aug. 14, 1986

[30] Foreign Application Priority Data

Nov. 21, 1985 [JP] Japan ..... 60-261981

[51] Int. Cl.[4] ..... B25C 5/11

[52] U.S. Cl. ..... 227/120; 227/156

[58] Field of Search ..... 227/120, 155, 156, 132, 227/146, 123, 110

[56] References Cited

U.S. PATENT DOCUMENTS

| | | | |
|---|---|---|---|
| 1,067,541 | 7/1913 | Palmgren | 227/95 X |
| 2,368,552 | 1/1945 | Place | 227/120 |
| 4,556,161 | 12/1985 | Oide | 227/120 |
| 4,607,777 | 8/1986 | Ebihara | 227/120 |

*Primary Examiner*—Paul A. Bell
*Assistant Examiner*—James L. Wolfe
*Attorney, Agent, or Firm*—Andrus, Sceales, Starke & Sawall

[57] ABSTRACT

The present invention provides a stapler including a base section having an anvil at its forward end, a frame section containing a set of staples and forwardly biasing the set of staples toward a through-opening on the forward end of the frame section, a handle section pivotally mounted on the frame section on the side opposite to the base section, the forward end of the handle section including an actuating member adapted to penetrate the through-opening in the frame section and to drive the forwardmost one of the staples in the frame section toward the anvil on the base section, at least the handle section being injection-molded with the actuating member, the actuating member having a thick-walled reinforcing portion extending along the length of the actuating member. The stapler also includes a staple restricting device for restricting the top of a staple when it is being driven by the actuating member, the staple restricting device including the reinforcing portion provided on the body of the actuating member at its forward face, the lower end of the reinforcing portion downwardly extending slightly beyond the lower end of the body of the actuating member.

3 Claims, 9 Drawing Figures

STAPLER

BACKGROUND OF THE INVENTION

1. Field of the Invention:

The present invention relates to improvements of a stapler for driving an inverted U-shaped staple and binding objects such as sheets of paper together by the driven staple passing therethrough.

2. Description of the Prior Art:

The inventor has previously proposed a stapler comprising a base section having an anvil provided thereon at the forward end, a frame section containing a set of steel staples and biasing them forwardly, said frame section including a through-opening portion formed therein at the forward end and aligned with each other, and a handle section pivotally mounted on the frame section on the side opposite to the base section and having an actuating member at the forward end of said handle section, said actuating member being adapted to penetrate said through-opening portion and then to drive the forwardmost one of said staples from said frame section toward the anvil on said base section, all of said base, frame and handle sections being made of a plastic material, said actuating member being molded integrally with said handle section and including a thick-walled reinforcing portion formed thereon. This construction is very advantageous in cost of manufacturing since the actuating member is formed integrally in the handle section using the same material as that of the handle section without need of mounting a separate steel piece on the handle section. However, the actuating steel member easily slips at its bottom face on the steel staple to promote wearing at the bottom face of the actuating member. Even if the bottom edge of the actuating member is slightly worn, the slippage is increased between the top of a staple and the bottom face of the actuating member. As a result, a staple cannot properly be driven downwardly and bind sheets of paper satisfactorily. Therefore, the stapler may become ineffective before the service life of the parts including the actuating member expires.

SUMMARY OF THE INVENTION

It is therefore an object of the present invention to provide a stapler which can positively and properly drive a staple without slippage between the top of the staple and the actuating member.

In order to accomplish the above object, the present invention provides a stapler of the aforementioned type which comprises means for restricting the top of a staple when it is being driven, said means including said reinforcing portion on the body of the actuating member at its forward face, said reinforcing portion having its lower end downwardly extending slightly beyond the lower end of the actuating member body.

Thus, no slippage will be produced between the top of a staple to be driven and the bottom of the actuating member in the presence of the staple restricting means. As a result, the actuating member formed integrally with the stapler handle section from a plastic material can be increased in service life.

DETAILED DESCRIPTION OF PREFERRED EMBODIMENTS

The present invention will now be described by some preferred embodiments thereof with reference to the accompanying drawings.

Figure 2:
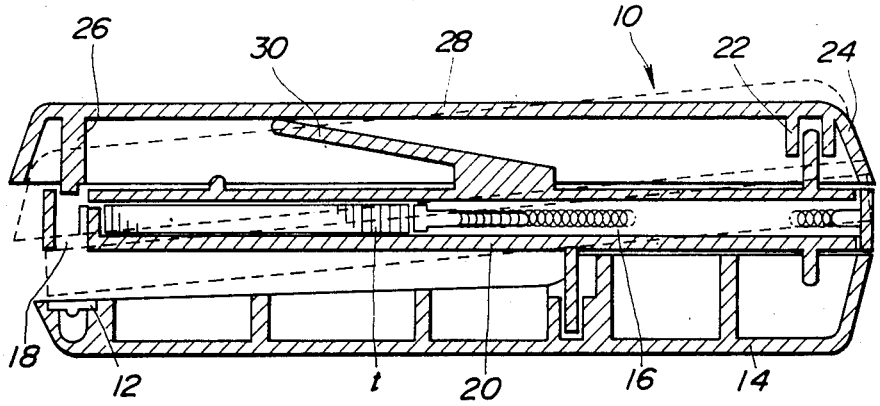
FIG. 2 is a longitudinal section of the entire stapler construction having the staple restricting means according to the present invention.

Referring first to FIG. 2, there is shown a stapler 10 constructed in accordance with the present invention. The stapler 10 comprises a base section 14 having an anvil 12 on the forward end thereof, a frame section 20 containing a set of staples t and biasing the staples t forwardly under the action of a coil spring 16 to position the forwardmost one of the staples at a position aligned with a through-opening 18 on the forward end of the frame section 20 and a handle section 28 including a boss 24 formed therein at the rearward end and receiving a projection 24 on the rearward end of the frame section 20 such that the handle section 28 can be pivoted relative to the frame 20 about the boss 22. The handle section 28 also includes an actuating member 26 on the forward end thereof, which co-operates with the through-opening 18 in the frame section 20 to drive the forwardmost staple therein. The handle section 28 is biased away from the frame section 20 under the action of a spring element 30 on the top of the frame section 20. The construction of such a stapler 10 is substantially the same as those of the prior art staplers of plastics. Therefore, parts other than the aforementioned parts will not be described herein.

On operation, the handle section 28 is manually pivoted toward the frame section 20 against the force of the spring element 30 while the base section 14 is manually held. The actuating member 26 on the handle section 28 then passes through the through-opening 18 of the frame section 20 as shown by broken line. The forwardmost one of the staples t in the frame section 20 is therefore driven downwardly toward the anvil 12 on the base section 14 and caulked by the anvil 12.

Figure 5:
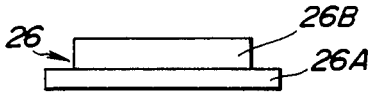
FIG. 5 is a bottom view of the actuating member shown in FIG. 4.

As seen from FIG. 2, at least the handle section 28 is injection-molded to have the integral actuating member 26. In accordance with the present invention, the actuating member 26 comprises a plate-like body portion 26A and a thick-walled reinforcing portion 26B formed thereon at the forward face. The reinforcing portion 26B extends along the length of the body portion 26A. The end configuration of the actuating member 26 with the reinforcing portion 26B is shown in FIG. 5. Due to such an end configuration, the rigidity of the actuating member 26 is increased to improve its service life.

Plastic materials suitable for use in the present invention include various plastics known as "engineering plastics" in the art, for example, ABS resins, polyacetals, polycarbonates, polyimides, polysulfone, glass-filled nylon and others. Normally, an actuating member of steel can be used through 30,000 drives. Experiments showed that an actuating member made of ABS resin could be used through 10,000 drives and that an actuating member of polyacetal could be used through 20,000 drives. Although the actuating members have the aforementioned durabilities, a slippage will be produced between the bottom face of an actuating member and a staple to be driven prior to expiry of its service life, so that the staple cannot properly be driven.

Figure 1:
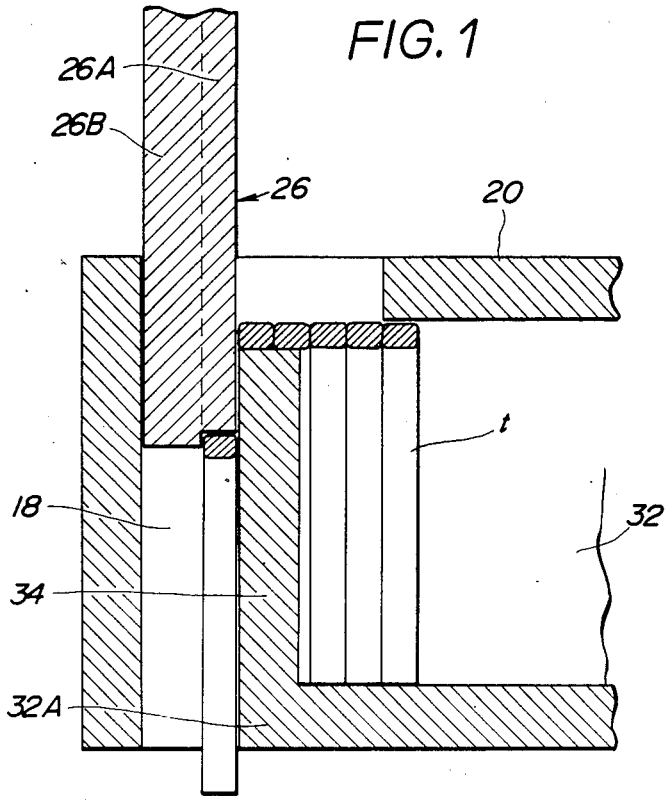
FIG. 1 is a fragmentary side cross-sectional view of the forward end of a frame section constructed according to the present invention and having staple restricting means.
Figure 4:
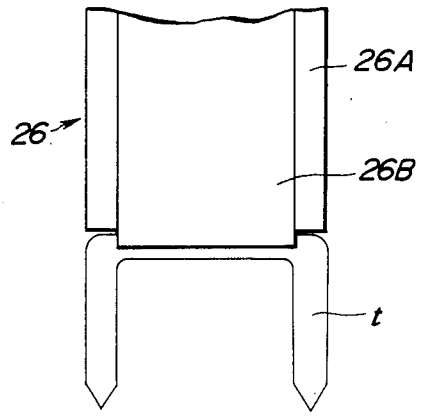
FIG. 4 is a front elevational view of an actuating member relating to the present invention.
Figure 6:
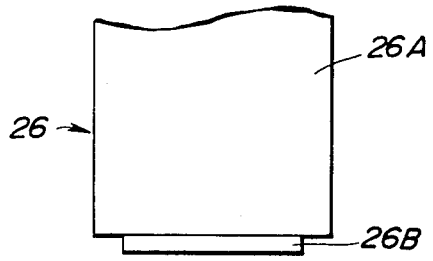
FIG. 6 is a back view of the actuating member shown in FIG. 4.

As seen from FIGS. 1, 4 and 6, the present invention provides staple restricting means including the lower end of the thick-walled reinforcing portion 26B of the actuating member 26 which downwardly extends beyond the lower end of the actuating member body 26A. When the handle section 28 (FIG. 2) is depressed to move the actuating member 26 into the throughopening 18 of the frame section 20 and to drive the forwardmost one of the staples in the frame section 20, the lower side face of the reinforcing portion 26B on the actuating member 26 engages the top forward face of the staple to be driven while the bottom face of the actuating member body 26A engages the top of the staple (its transverse portion of the inverted U). As a result, the top of the staple can firmly be held during driving. Accordingly, no slippage will be produced between the staple and the bottom of the actuating member 26.

Figure 3:
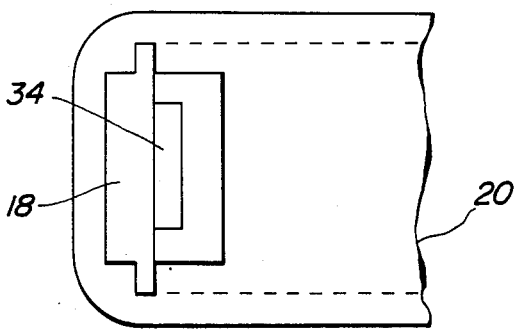
FIG. 3 is a plan view, shown by a reduced scale, of the parts shown in FIG. 1.

It is preferred that the staple restricting means also includes a back-up element 34 vertically extending in the staple containing portion 32 of the frame section 20 at the forwardmost end 32A thereof, as seen from FIGS. 1 and 3. The back-up element 34 is located immediately behind the path of the actuating member 26 moving through the through-opening 18 of the frame section 20 and has such a width and height that will not interfere with the movement of the driven staple. Thus, the back-up element 34 can further increase the restriction of staples to be driven. It is further preferred that the back-up element 34 has its top face very close to the lower face of the top of the staple t contained within the frame section 20.

Figure 9:
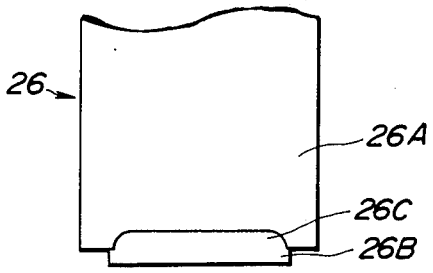
FIG. 9 is a back view of still another modified actuating member according to the present invention.

The bottom face of the actuating member 26 is more worn at its opposite side edges. Only the central area on the bottom face of the actuating member 26 is frequently used to initially drive the staple. At this case, the central area on the top of a staple to be driven is first deformed downwardly, resulting in fault of the driving function. It is preferred that there is provided a recess 26C on the bottom of the actuating member body 26A and behind the reinforcing portion 26B. See FIG. 9 Thus, even if the bottom of the actuating member body **26*a* is worn at its opposite side edges, a staple will not be driven by the actuating member 26** engaging only the central area on the top of the staple.

Figure 7:
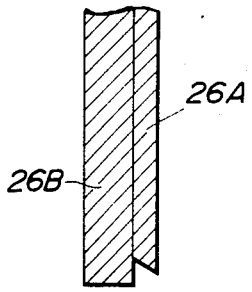
FIG. 7 is a vertical cross-section of a modified actuating member according to the present invention.
Figure 8:
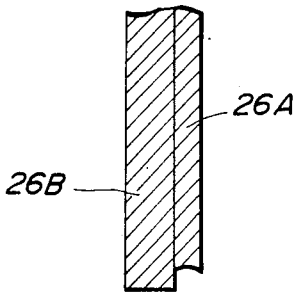
FIG. 8 is a vertical cross-section of another modified actuating member according to the present invention.

The bottom face of the actuating member body 26A is not necessarily to be horizontal as shown in FIG. 1. For example, the bottom face of the body 26A may be slanted upwardly toward the reinforcing portion 26B as shown in FIG. 7 or may be arcuated inwardly as shown in FIG. 8. Such configurations may similarly provide the staple restricting function.

I claim:

1. A stapler comprising a base section having an anvil at its forward end, a frame section containing a set of staples and forwardly biasing said set of staples toward through-opening means on the forward end of said frame section, a handle section pivotally mounted on said frame section on the side opposite to said base section, a forward end of said handle section including actuating means adapted to penetrate said through-opening means in said frame section and to drive the forwardmost one of said staples in said frame section toward the anvil on said base section, at least said handle section being injection-molded with said actuating means, said actuating means having a body portion (26A) and a thick-walled reinforcing portion (26B) extending along the length of the forward portion of said body portion, the improvement comprising staple restricting means for restricting the top of a staple against forward slippage when the staple is being driven by said actuating means, said staple restricting means including a lower end portion of said reinforcing portion which extends downwardly slightly beyond a lower end of said body portion of said actuating means to engage the forward face of the top of the staple.

2. A stapler as defined in claim 1 which further includes a back-up element (34) located in the path of the staples moving in said frame section, said back-up element being positioned immediately behind the path of said actuating means moving past said through-opening means in said frame section, said back-up element having such a width and height that it will not interfere with the movement of said staples within said frame section, said back-up element furthermore having a top face adapted to be positioned closely adjacent a said top of a staple.

3. A stapler as defined in claim 1 or 2 wherein a bottom end of said body portion is recessed (26C) behind said reinforcing portion.

* * * * *